United States Patent [19]

Heniges

[11] Patent Number: 4,485,768

[45] Date of Patent: Dec. 4, 1984

[54] SCOTCH YOKE ENGINE WITH VARIABLE STROKE AND COMPRESSION RATIO

[76] Inventor: William B. Heniges, 3325 SE. 120th Ave., Portland, Oreg. 97266

[21] Appl. No.: 530,485

[22] Filed: Sep. 9, 1983

[51] Int. Cl.[3] ..... F02B 75/28

[52] U.S. Cl. ..... 123/48 B; 123/48 R; 123/56 R; 123/56 BC; 123/56 AC; 123/78 R; 123/78 BA; 123/78 A; 123/82; 123/197 R; 92/13.1; 92/13.4; 74/602; 74/600

[58] Field of Search ..... 123/56 R, 56 A, 56 B, 123/56 BC, 56 AC, 52 A, 48 R, 48 A, 48 B, 78 R, 78 A, 78 BA, 78 F, 78 E, 82, 197 R, 197 AB, 197 AC; 92/13.1, 13.4, 13.7

[56] References Cited

U.S. PATENT DOCUMENTS

| | | | |
|---|---|---|---|
| 756,011 | 3/1904 | Fitzgerald | 123/56 AC |
| 2,184,820 | 12/1939 | Tucker | 123/56 BC |
| 3,630,178 | 12/1971 | Erickson | 123/197.9 |
| 3,861,239 | 1/1975 | McWhorter | 123/197 AC |
| 4,112,826 | 9/1978 | Cataldo | 123/48 B |
| 4,182,288 | 1/1980 | Thauer | 123/78 AA |
| 4,270,495 | 6/1981 | Freudenstein et al. | 123/54 B |
| 4,319,498 | 3/1982 | McWhorter | 123/197 AC |

*Primary Examiner*—Craig R. Feinberg
*Assistant Examiner*—David A. Okonsky
*Attorney, Agent, or Firm*—James D. Givnan

[57] ABSTRACT

A yoke type engine wherein the orbital path of the slider is alterable to effect piston stroke and compression ratio changes. A crank component has a crankpin which carries and positions the slider. A boss of the crank component is carried by a control shaft in an offset manner. Timing gears normally drive the control shaft in synchronization with the crankshaft to maintain a constant stroke and compression ratio. Relocation of certain timing gears by an actuator causes the control shaft to rotationally advance or retard to reposition the crank component carried thereby to in turn alter the orbital path of the coaxial crankpin and slider relative to a crankshaft axis. Accordingly, high and low compression orbits for the slider may be effected to best suit engine loads. A variable length throw couples the slider to the crankshaft. The orbital path of the slider provides increased crankshaft leverage over conventional engine arrangements.

16 Claims, 13 Drawing Figures

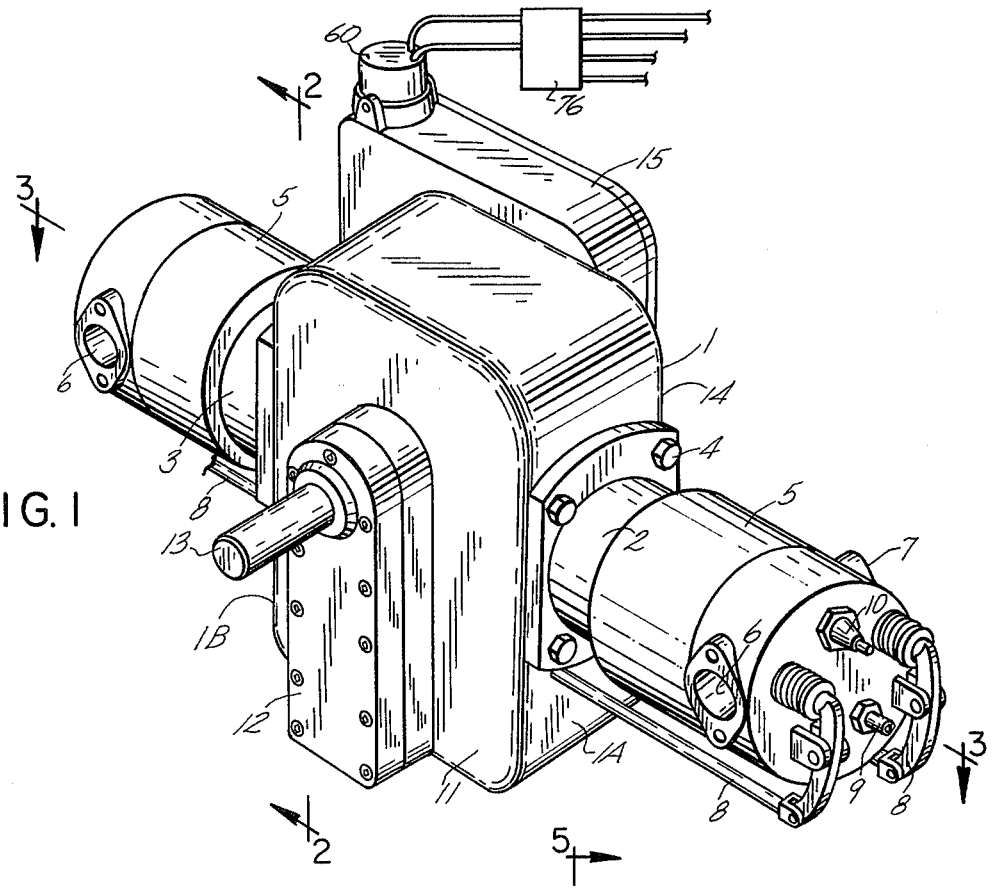
FIG. 1
FIG. 2
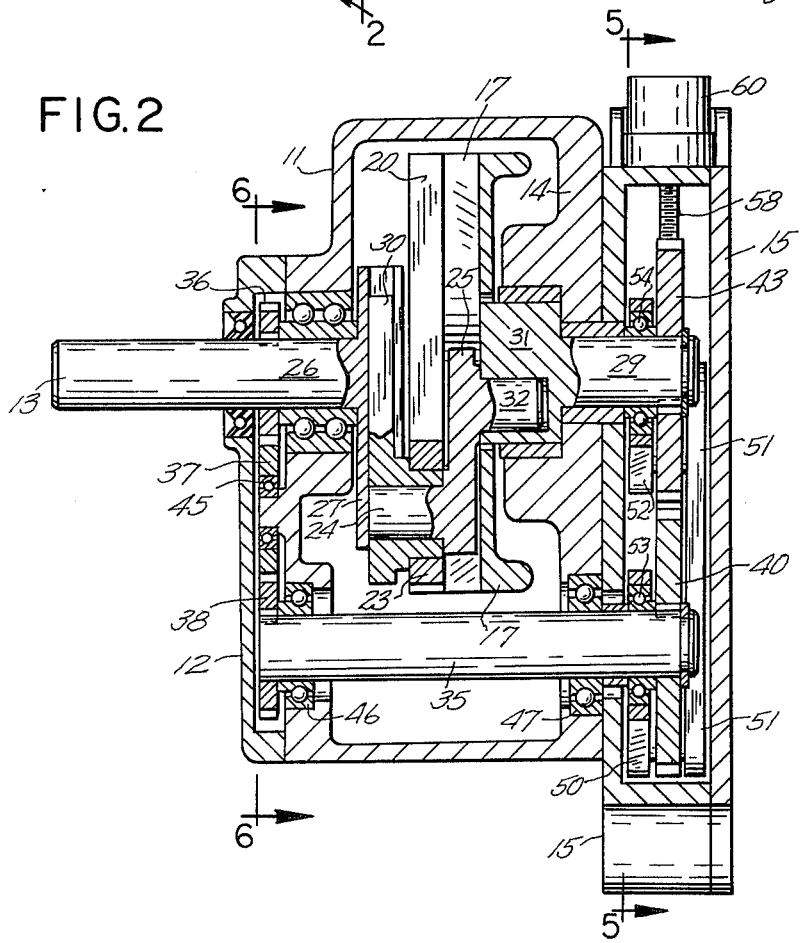

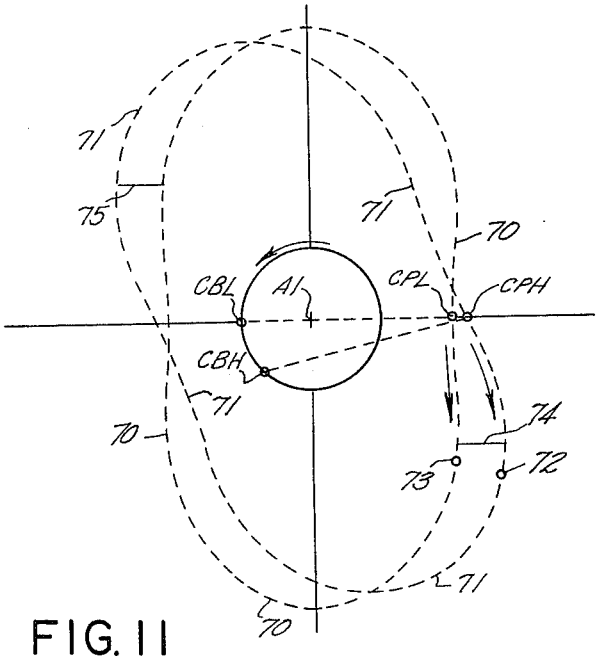
FIG. 11
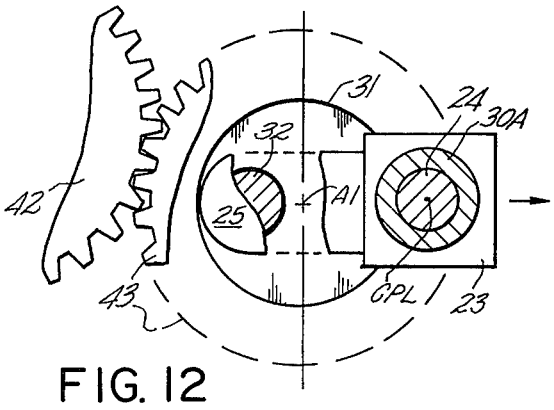
FIG. 12
FIG. 13
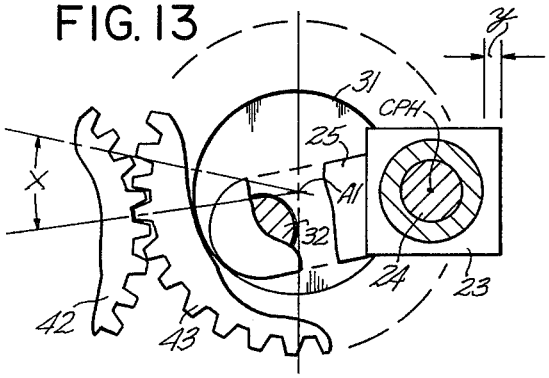
FIG. 5
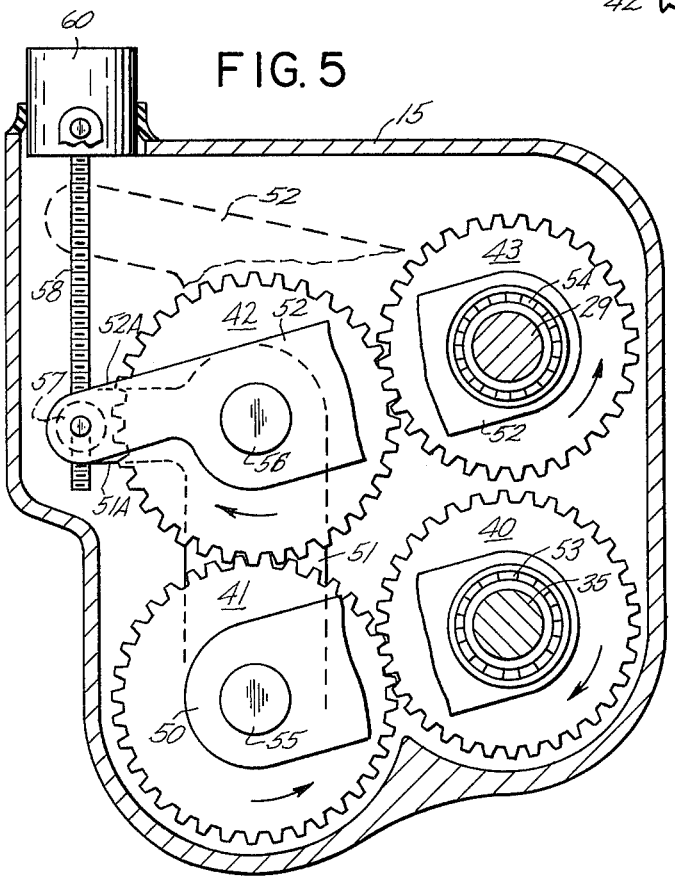
FIG. 6
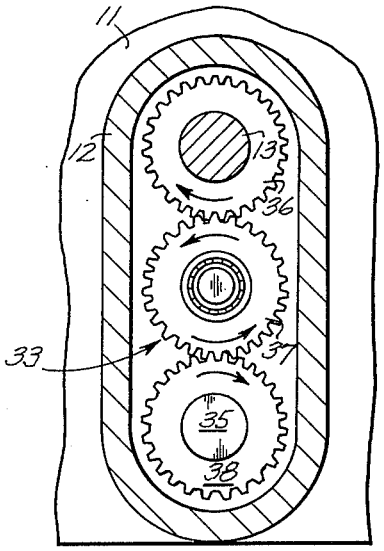

SCOTCH YOKE ENGINE WITH VARIABLE STROKE AND COMPRESSION RATIO

BACKGROUND OF THE INVENTION

The present invention concerns internal combustion engines and particularly an engine wherein the compression ratio may be varied during operation to best adapt the engine to load conditions.

In the prior patent art are numerous Scotch yoke type engine disclosures which by their nature include opposed cylinders, pistons affixed to a common yoke with rectilinear yoke motion being translated into rotary motion by an offset crankpin of a crankshaft. For one or more reasons, yoke type internal combustion engines have not been adopted by the automotive industry. Further, such engines disclosed in the prior patent art, to the best of my knowledge, have no capability for altering piston stroke during engine operation.

Prior patent art includes U.S. Pat. No. 4,270,495 which discloses an engine capable of different piston stroke lengths and compression ratios. The engine has a pair of parallel cylinders arranged in side-by-side fashion and relies on an adjustable crankshaft mechanism positionable toward or away from the cylinders to effect stroke and compression changes. U.S. Pat. No. 4,112,826 shows a similar engine.

U.S. Pat. No. 4,182,288 is of interest as it discloses an engine with an adjustable compression chamber using an auxiliary cylinder and positionable piston therein with the chamber in communication with an engine cylinder. The volume of the auxiliary cylinder is variable to vary the total combustion chamber of a cylinder. The patent is additionally of interest in that it discloses means for altering phase relationships between driving and driven shafts.

U.S. Pat. No. 3,861,239 discloses the concept of a connecting rod coupled to a crankshaft by an eccentric bearing which rotates during engine operation to alter the piston stroke. U.S. Pat. No. 4,319,498 shows similar engine structure.

Other crankshaft-connecting rod disclosures are directed toward elliptical crankpin travel about a crankshaft axis to vary piston dwell at top dead center as shown in U.S. Pat. No. 1,873,908.

SUMMARY OF THE PRESENT INVENTION

The present invention concerns an internal combustion engine of the yoke type wherein the orbit of a crankpin and the slider thateon is oval for optimum leverage and may be altered to change the piston stroke and compression ratio of the engine.

The engine includes, briefly, a yoke fitted with a piston at each end with the yoke imparting orbital motion to a slider confined within a yoke defined raceway. A control shaft may be advanced or retarded to enable altering the path of the slider and accordingly the stroke and dwell of the yoke carried pistons. The stroke changes effect low and high compression engine modes. Further, the dwell of the piston at top dead center permits the slider and crankpin to move to an advantageous position, offset from the crank axis, for optimum throw leverage on the crankshaft.

Means for altering the slider orbit may include a set of gears and an actuator therefor which momentarily accelerate or decelerate the control shaft which adjustably carries the crankpin and slider. The yoke driven slider drives the crankshaft via a two-piece variable throw which accommodates the alterable orbital travel of the slider.

Important objective of the present engine include the provision of an engine with variable compression ratio without reliance on an auxiliary piston arrangement as earlier proposed and which is subject to wear, noisy operation and costly manufacture; the provision of an engine wherein a yoke driven slider has separate orbital paths resulting in high and low compression modes of engine operation; the provision of an engine having a variable length crankshaft throw assembly; the provision of an engine wherein a yoke driven slider travels an oval path with the piston power stroke associated, for optimum crankshaft leverage, with the travel of the slider about the ends of the oval remotely disposed from the crankshaft axis; the provision of compression control means wherein certain gears of a gear set are laterally displaceable to retard or advance control shaft speed to relocate the slider path and hence alter the engine compression ratio; the provision of an engine preferably of the two stroke, yoke type which lends itself to supercharging;

BRIEF DESCRIPTION OF THE DRAWINGS

In the accompanying drawings:

FIG. 1 is a perspective view of the present engine;

FIG. 2 is a vertical sectional view thereof taken along line 2—2 of FIG. 1;

FIG. 5 is a vertical sectional view thereof taken along line 5—5 of FIG. 2;

FIG. 6 is a vertical sectional view thereof taken along line 6—6 of FIG. 2;

FIG. 11 is a schematic view of the high and low compression racetrack orbits travelled by the coaxial slider and crankpin;

FIG. 12 is a schematic view of a low compression relationship of the crank component, slider and control shaft; and FIG. 13 is a view similar to FIG. 12 but showing the components in a high compression relationship achieved by advancing a crank boss.

DETAILED DESCRIPTION OF THE PREFERRED EMBODIMENTS

Figure 3:
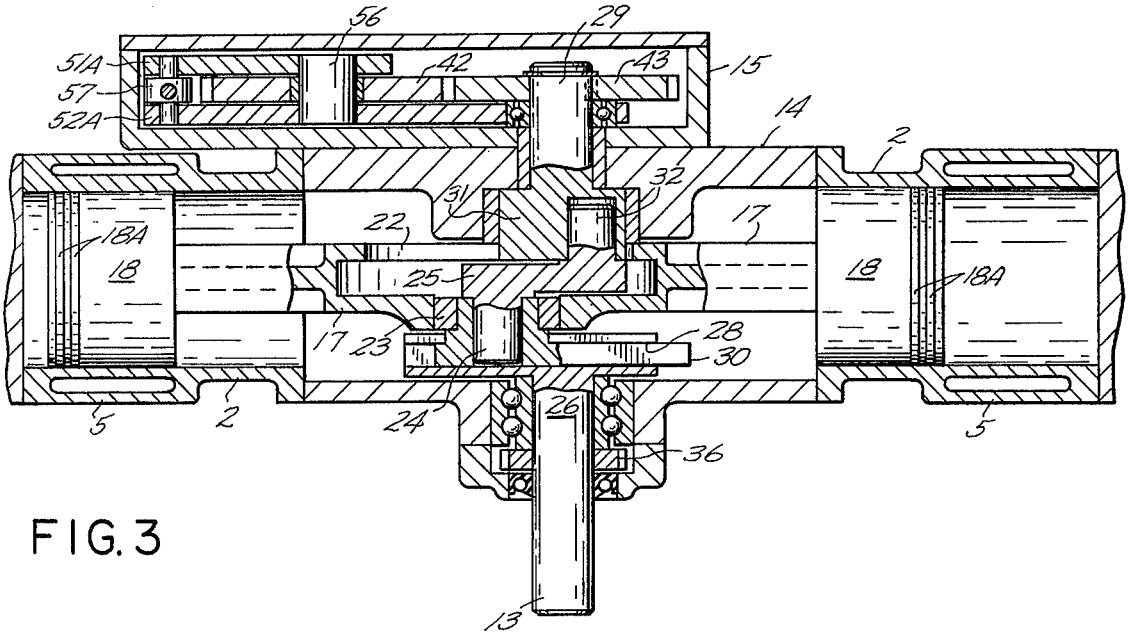
FIG. 3 is a horizontal sectional view thereof taken along line 3—3 of FIG. 2.

With continuing attention to the drawings wherein applied reference numerals indicate parts hereinafter similarly identified, the reference numeral 1 indicates a case for the present engine and having aligned cylinders 2 and 3 oppositely disposed on the case sides 1A-1B by suitable fasteners 4 extending through each cylinder base. The case may serve as an oil reservoir and is equipped with the components of a pressure lubrication system the details of which are unimportant for present purposes.

Each cylinder may include a jacketed segment 5 for a coolant flow, air inlet and exhaust outlet ports as at 6 and 7, valve actuating means as at 8 and a spark plug at 10. A fuel injector is at 9.

A front wall 11 of the engine case supports a gear housing 12 through which a power output shaft 13 passes. The gear train or set within housing 12 forms part of a timing mechanism as later explained. On a rear wall 14 of the engine case is a second gear housing at 15 within which are additional timing gears of a train or set operable to establish low and high compression modes of the engine operation.

Figure 4:
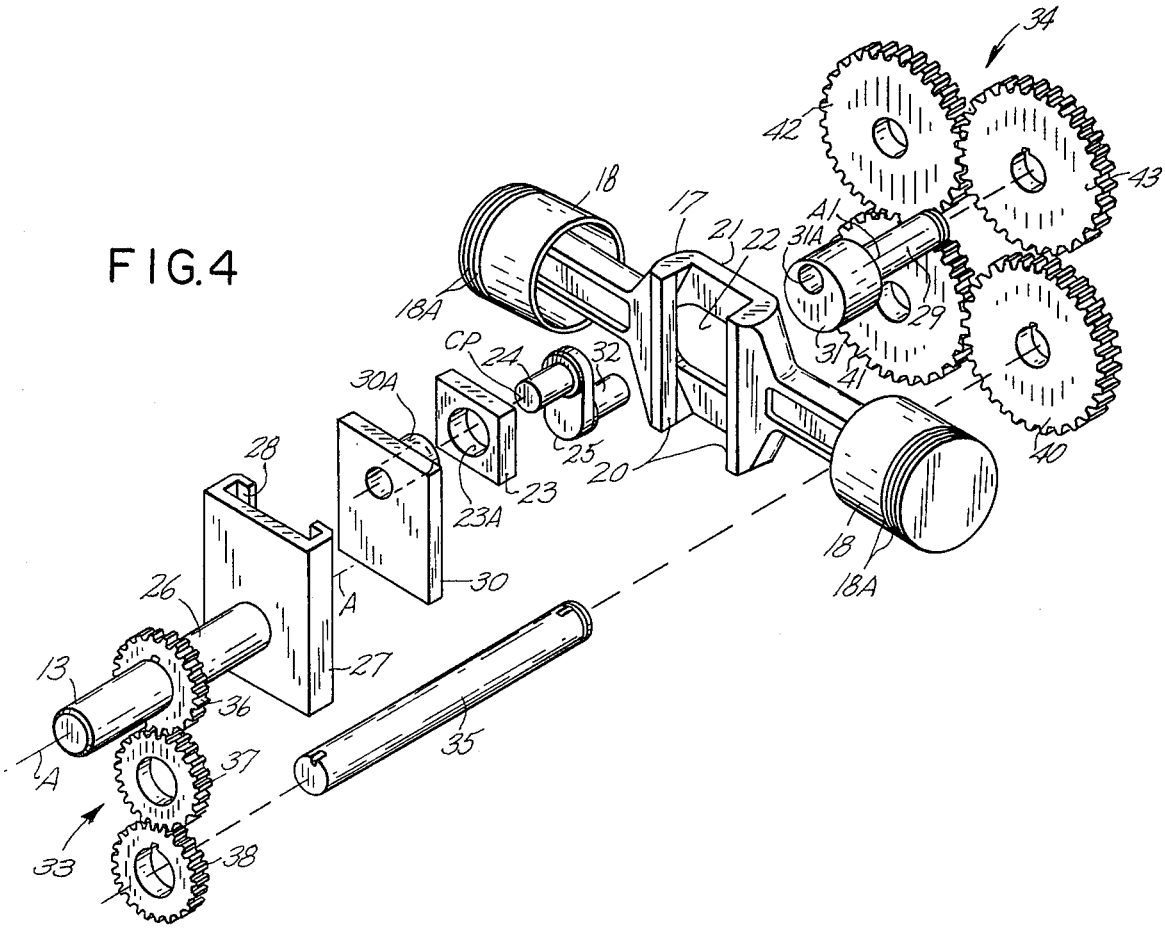
FIG. 4 is an exploded perspective view of the engine's internal parts.

A yoke is indicated at 17 in FIG. 4 and includes end mounted pistons 18 with rings 18A. The yoke or crosshead of the engine defines a raceway 20 extending crosswise of the yoke horizontal axis. A rear wall 21 of the yoke defines an elongate opening 22 orientated lengthwise of the yoke axis.

Slidably disposed within raceway 20 is a slider block 23, termed a slider, apertured at 23A to receive a bushing 30A on a throw 30. A crankpin 24 of a later described crank component 25 is received within bushing 30A. Slider block 23 is constrained for oval movement by reason of the axis CP of crankpin 24 orbiting in an oval path about the axis A of an engine crankshaft at 26. Rotary motion is accordingly imparted to said crankshaft by a variable length throw assembly including a main throw 27 chanelled at 28 to receive sliding throw 30 which reciprocates within the main throw during crankshaft rotation. During one rotation of the variable length throw assembly, throw 30 will extend and retract in a telescopic manner while imparting rotation to crankshaft 26.

Sliding throw 30, provided with a bushing 30A, receives slider block 23 thereon with crankpin 24 passing therethrough and terminating in a flush manner within the throw 30. Main throw 27 of the throw assembly is preferably equipped with bearings (not shown) disposed along its opposed inner edges to support sliding throw 30 in a low friction manner.

In the preferred embodiment of the engine, drive means serves to drive and change phase of a control shaft 29 during engine operation to effect low or high compression engine modes. Control shaft 29 has an axis A1 in alignment with crankshaft axis A and includes an enlarged head portion 31 with a radially offset bore at 31A to receive a crank boss 32 of crank component 25. Momentary differential speeds, as later explained, between control shaft 29 and engine crankshaft 26 serve to reorientate the crank boss relative control shaft 29 to vary the throw of the crank component as best illustrated in FIGS. 12 and 13. The phase relationship between control shaft 29 and crankshaft 26 is hence simultaneously altered. The drive mechanism includes a first set of gears indicated generally at 33 and a second set of gears generally at 34 in front and rear housings 12 and 15. A shaft 35 couples the sets of gears of a power transmission means driving the control shaft. Said first set of gears at 33 includes gears 36, 37 and 38 provided for the purpose of imparting rotation from the output end of crankshaft 26 to shaft 35 which in turn imparts rotation to the second set or train of timing gears 40, 41, 42 and 43. Gear 43 and hence control shaft 29 are accordingly normally driven in an synchronous manner with crankshaft 26 at a 1 to 1 ratio.

Gear 36 of the first set of gears is carried by crankshaft 26 while gear 37 is on a case supported bearing 45. Gear 38 is carried by shaft 35 in bearings 46 and 47.

With reference to FIGS. 2, 4 and 5, gear 40 of the second set of gears is carried by shaft 35. Gears 41 and 42 are carried by a parallelogram linkage including arms 50, 51 and 52 constituting part of a compression control mechanism. Arms 50 and 52 are journaled respectively at their proximal ends by bearings 53 and 54 on timing shaft 35 and control shaft 29. Stub shafts 55 and 56 carry the suitably journaled timing gears 41 and 42 with each shaft carried at the distal ends of parallelogram arms 50 and 52. Arm extensions at 51A and 52A receive a pivotally mounted nut 57 entrained on a threaded shaft 58. A reversible electric compression control motor 60 is yieldably mounted on gear housing 15 with motor operation in response to an engine monitoring signal source. Accordingly, swinging movement is imparted to the parallelogram arms during the course of a compression ratio change as described below.

With the parallelogram linkage stationary in any adjusted position, the first and second set of timing gears will drive control shaft 29 counter to but in synchronization with crankshaft 26. Momentary speed changes in control shaft 29 (relative crankshaft 26) are effected by movement of the arm linkage by compression control motor 60. For example, in FIG. 5, lifting of the linkage will momentarily decrease the rotational speed of gear 43 to cause associated control shaft 29 to momentarily slow somewhat to be out of phase with crankshaft 26 to change from the FIG. 13 high compression relationship to the FIG. 12 low compression relationship. The head portion 31 of control shaft 29 with its radially offset bore 31A controls the position of crank component 25 by arcuately advancing or retarding crank boss 32 about control shaft axis A1(FIGS. 12 and 13) during phase changes to relocate the orbital path of the slider (per FIG. 11). A momentary decrease in the rotational speed of control shaft 29 and its head 31 will result in crank component boss 32 being retarded 45 degrees or so to the FIG. 12 position. Such retardation reduces the effective throw of crank component 25 and specifically crankpin 24 to effect a low compression mode. Conversely, reverse operation of compression control motor 60 will reposition the arm linkage downwardly to momentarily accelerate gear 43 to cause control shaft 29 to advance 45 degrees (per FIG. 13) from the low compression mode of FIG. 12 to the high compression mode of FIG. 13. These gear speed and compression mode changes occur through a period of several engine revolutions.

Figure 7:
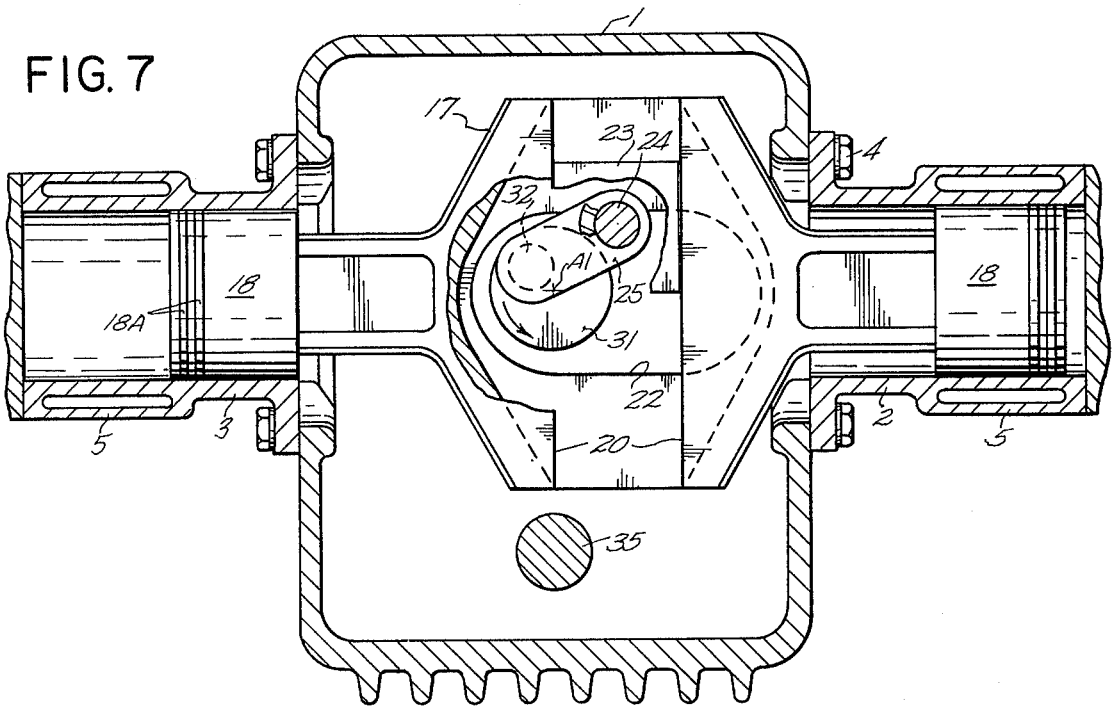
FIGS. 7 through 10 are vertical sectional schematics of the engine illustrating yoke and slider relationships during partial rotation of the engine crankshaft.
Figure 8:
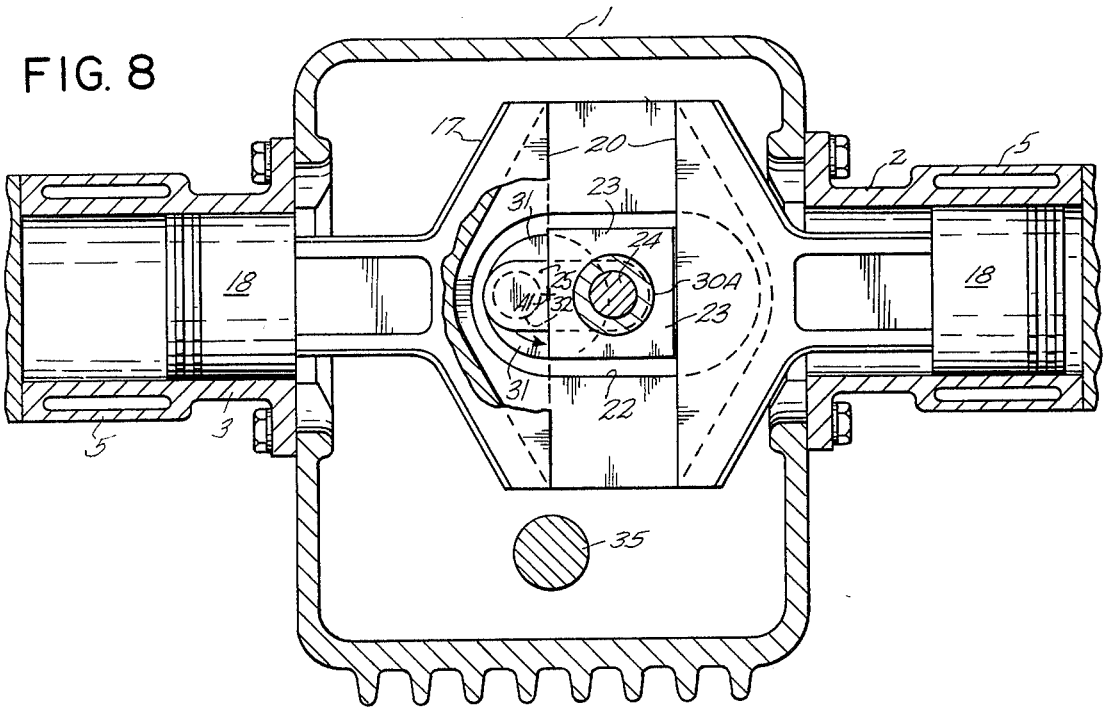
Figure 9:
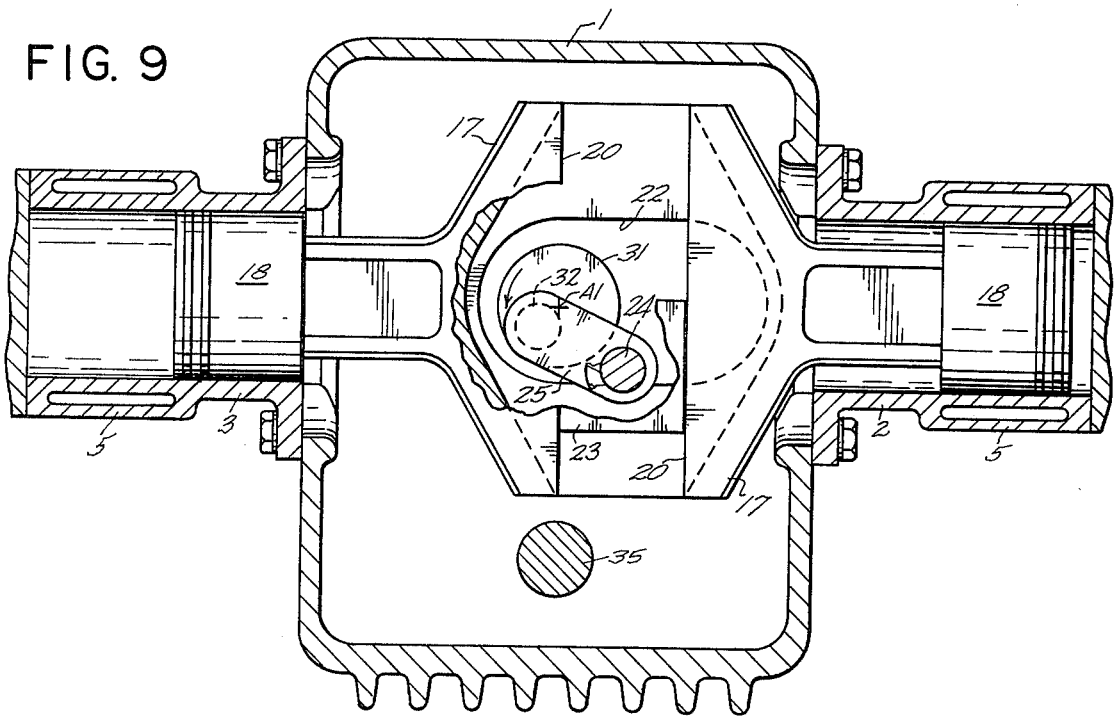
Figure 10:
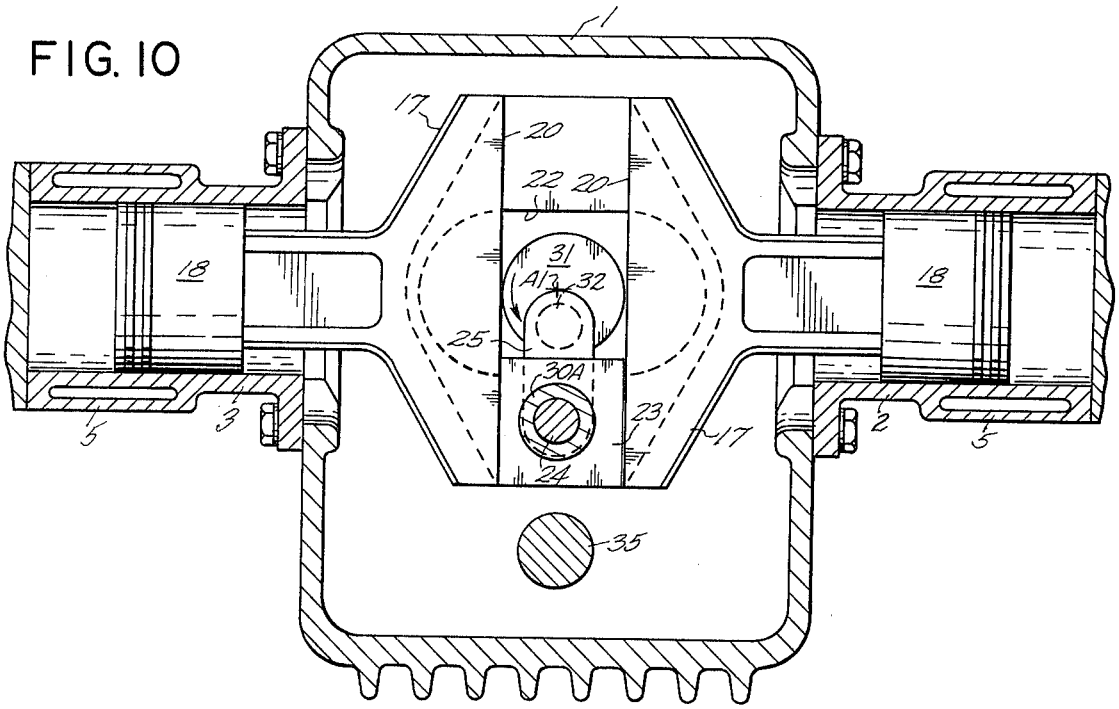

For an understanding of the schematic of FIG. 11, reference is made to FIGS. 7 through 10. In FIGS. 7 through 9, the crankpin and slider are travelling along a straight path of low compression orbit 70 with FIG. 9 being coincident with ignition. FIG. 10 shows the slider and crankpin position midway through a power stroke.

With attention to FIG. 11 which discloses the low and high compression orbital paths at 70-71 of coaxial slider 23 and crankpin 24. Upright orbital path at 70 is followed by the coaxial crankpin and slider during the low compression mode of engine operation while inclined orbital path 71 is followed during the high compression mode.

In FIG. 11, CBL and CPL indicate the position of the crank boss axis and crankpin axis at low compression top dead center of one piston.

CBH and CPH indicate the positions of the crank boss axis and crankpin axis at high compression mode operation.

For optimum leverage of the crank component on crankshaft 26 ignition in both engine modes will be coincident with maximum cylinder pressure and at the point on the crankpin orbit 70 or 71 whereat the crankpin axis is at its greatest distance from a horizontal plane common to axis A of crankshaft 26. Ignition occurs accordingly at 72 in the high compression mode and at 73 in the low compression mode. The 45 degree repositioning of CBL to CBH shown in FIGS. 11, 12 and 13 is achieved with the earlier described compression control mechanism accomplishing the approximately 45 degree shift of boss 32 (FIG. 13) over a duration of several engine rotations. The 45 degree shift is jointly attributable to displacement X of gear 2 and a speed change therein. Assuming the engine were static, the slider 23 would be displaced a distance Y by such a shift.

For the same piston associated with the above noted points on the orbits 70 and 71 the opposite extreme of travel or extreme of the intake stroke will occur at points on the orbits diametric to points 72 and 73.

The increase in the high compression stroke over the low compression stroke is represented in FIG. 11 by the two or maximum horizontal variances at 74 and 75 between the orbits.

Drive means operable between crankshaft 26 and control shaft 29 may be other wise embodied. For example and with reference again to U.S. Pat. No. 4,182,288 wherein a hydraulic system is utilized to advance or retard the rotation of one shaft relative to an engine crankshaft to change the phase relationship between the shafts. In the previously patented system the driven shaft in turn drives an auxiliary piston on an engine auxiliary combustion chamber to vary total combustion chamber volume and hence engine compression ratio. A still further timing arrangement may include a planetary drive to alter shaft speed such as disclosed in U.S. Pat. No. 3,961,607.

Compression ratio changes in the present engine result from signals imparted from an engine monitoring unit at 76. Said unit may be of the general type incorporating computer components responsive to several engine parameters such as those units currently in the automotive field.

In a simplified form of the present engine the compression control mechanism is dispensed with to provide an engine of fixed piston stroke and compression ratio.

While I have shown but a few embodiments of the invention it will be apparent to those skilled in the art that the invention may be embodied still otherwise without departing form the spirit and scope of the invention.

Having thus described the invention, what is desired to be secured under a Letters Patent is:

1. A yoke type engine with variable piston strokes and compression ratios, said engine comprising,
- a case having multiple cylinders,
- a yoke having a centrally located raceway and end mounted pistons,
- a crankshaft including a variable length throw assembly,
- a slider within said raceway and having an oval path with straight segments and curved segments, said slider imparting rotation to said crankshaft,
- drive means including,
  - a control shaft for synchronized counter rotation to said crankshaft,
  - a crank component having a crankpin and a boss,
  - said control shaft receiving said crank component boss in a radially offset manner whereby shaft rotation will orbit said boss in one direction about the control shaft axis,
  - said crankpin of the crank component coaxial with and carrying said slider for orbit in an direction opposite to crank boss orbit direction and determining piston stroke and compression ratio, and
- power transmission means normally driving said control shaft in phase with said crankshaft but in counter rotation thereto and including,
  - a compression control mechanism operable to rotationally advance and retard the control shaft relative crankshaft rotation to reposition the crank boss carried by the control shaft whereby the orbital path of the crankpin and slider will be altered to alter piston stroke and compression ratio,
  - an actuator responsive to an engine monitoring signal source and controlling said compression control means.

2. The engine claimed in claim 1 wherein the coaxial slider and crankpin travel an oval racetrack path about a projected axis of the control shaft with momentary changes in control shaft speed relative the speed of the engine crankshaft causing said control shaft to advance and retard the crank boss to relocate the racetrack path of the slider and crankpin.

3. The engine claimed in claim 1 wherein said variable length throw assembly includes a main throw, a sliding throw carried thereby and coupled to said crankpin at the sliding throw distal end.

4. The engine claimed in claim 1 wherein said power transmission means includes gear sets, said compression control mechanism including gear supporting linkage wherein certain gears of one set may be laterally displaced relative other gears of said one set having fixed axes, one of said other gears carried by said control shaft to cause a momentary speed change in the control shaft for rotational repositioning of said crank boss.

5. The engine claimed in claim 4 wherein one of said gear sets is directly driven by said crankshaft.

6. The engine claimed in claim 4 wherein said linkage is a parallogram linkage, said actuator coupled to said linkage to reposition same for stroke and compression changes.

7. The engine claimed in claim 6 wherein said actuator is a reversible electric motor, a threaded shaft powered by said motor, said linkage coupled to said shaft and positionable thereby.

8. An internal combustion yoke type engine including,
- a case having multiple cylinders,
- a yoke having end mounted pistons and defining a centrally located raceway,
- a slider confined within said raceway and having an oval path with straight segments and curved end segments,
- an engine crankshaft including a variable length throw assembly, said slider imparting rotary motion to the throw assembly, and
- drive means including,
  - a crank component having a crank boss and a crankpin, said crankpin controlling the oval path of the slider,
  - a control shaft within one end of which said crank boss is journaled in a radially offset manner,
  - power transmission means driven by the engine crankshaft and imparting rotation to said control shaft for rotation of said control shaft opposite to the direction of said crankshaft wherein said crank boss is carried by said control shaft to orbit in a direction opposite to the path of the crankpin controlled slider to provide the oval crankpin and slider path, the power strokes of said pistons being simultaneous with slider travel along the curved end segments of said path.

9. The engine claimed in claim 8 wherein said power transmission means includes compression control means operable to rotationally advance and retard the crank boss to reposition same and hence alter the path of the crankpin and slider to vary piston stroke and compression ratio of the engine.

10. The engine claimed in claim 9 wherein said compression control means includes a gear set having laterally displaceable gears, linkage supporting said displaceable gears, signal receiving means operable to shift said linkage in response to sensed engine conditions whereby a phase change will occur between the crank boss carrying means and said crankshaft.

11. An internal combustion yoke type engine including, a case having multiple cylinders, a yoke having end mounted pistons and defining a centrally located raceway, a slider confined within said raceway and having an oval path with straight segments and curved end segments, an engine crankshaft including a variable length throw assembly, said slider imparting rotary motion to the throw assembly and drive means including a control shaft, a positionable crank component including a crank boss journaled in a radially offset manner within said control shaft, said crank component further including a crankpin coupled to said slider, power transmission means imparting rotation to said control shaft opposite to engine crankshaft rotation, a compression control mechanism for momentarily accelerating and retarding said control shaft into a new phase relationship with the engine crankshaft to reposition the crank component and particularly the crankpin thereof to cause the slider to change its orbital path resulting in stroke and compression ratio changes, said compression control mechanism further including a signal receiving actuator responsive to an engine monitoring device.

12. The engine claimed in claim 11 wherein said variable length throw assembly includes a main throw, a sliding throw carried thereby and coupled to said crankpin at the sliding throw distal end.

13. The engine claimed in claim 11 wherein said drive means includes power transmission components including first and second gear sets, said compression control mechanism including gear supporting linkage wherein gears of one of said sets may be laterally displaced relative the remaining gears of said set by said actuator to cause a momentary speed change in the control shaft.

14. The engine claimed in claim 13 wherein said linkage is of a parallelogram type.

15. The engine claimed in claim 13 wherein one of said gear sets is directly driven by said crankshaft.

16. The engine claimed in claim 13 wherein said actuator is a reversible electric motor, shaft means coupling said motor to said linkage.

* * * * *